US007488163B2

(12) United States Patent
Enzaka et al.

(10) Patent No.: US 7,488,163 B2
(45) Date of Patent: Feb. 10, 2009

(54) TROCHOID OIL PUMP

(75) Inventors: Kazuo Enzaka, Gunma-ken (JP); Masahiro Kasahara, Gunma-ken (JP); Yasunori Ono, Gunma-ken (JP); Kenichi Fujiki, Gunma-ken (JP); Keiichi Kai, Gunma-ken (JP); Yoshiaki Senga, Gunma-ken (JP); Atsushi Kaneko, Gunma-ken (JP)

(73) Assignee: Yamada Manufacturing Co., Ltd., Kiryu-shi, Gunma-ken (JP)

( * ) Notice: Subject to any disclaimer, the term of this patent is extended or adjusted under 35 U.S.C. 154(b) by 271 days.

(21) Appl. No.: 11/312,444

(22) Filed: Dec. 21, 2005

(65) Prior Publication Data

US 2006/0140809 A1 Jun. 29, 2006

(30) Foreign Application Priority Data

Dec. 27, 2004 (JP) ..... 2004-378193

(51) Int. Cl.
*F04C 2/10* (2006.01)

(52) U.S. Cl. ..... 418/190; 418/61.3; 418/166; 418/171; 418/189

(58) Field of Classification Search ..... 418/166, 418/171, 104, 108, 143, 189, 190, 61.3
See application file for complete search history.

(56) References Cited

U.S. PATENT DOCUMENTS 4,504,202 A * 3/1985 Saegusa ..... 418/171
4,976,595 A * 12/1990 Taniguchi ..... 418/171
5,139,395 A * 8/1992 Kemmner ..... 418/171
6,474,752 B2 * 11/2002 Harada et al. ..... 418/171
7,384,251 B2 * 6/2008 Fujiki et al. ..... 418/61.3
2003/0165392 A1 * 9/2003 Hosono ..... 418/171
2004/0022660 A1 * 2/2004 Eisenmann et al. ..... 418/171
2004/0057860 A1 * 3/2004 Amano et al. ..... 418/171
2004/0091379 A1 * 5/2004 Pippes ..... 418/166
2004/0191101 A1 * 9/2004 Ogata et al. ..... 418/171

FOREIGN PATENT DOCUMENTS

JP 5-215079 8/1993

* cited by examiner

*Primary Examiner*—Thomas E Denion
*Assistant Examiner*—Mary A Davis
(74) *Attorney, Agent, or Firm*—McGinn IP Law Group, PLLC

(57) ABSTRACT

A trochoid oil pump, which enables the endurance to be increased and the reduction of discharge pulsations and noise to be achieved, and in which those results can be realized with a very simple structure.

An interdental space constituted by an inner rotor and an outer rotor having trochoid tooth profile or substantially trochoid tooth profile starts a compression stroke in the location of a partition section between an intake port and a discharge portion, and a linking gap L is composed by the interdental space and a preceding adjacent interdental space realized in a discharge stroke. The linking gap expands gradually from the start of compression stroke to the discharge stroke.

19 Claims, 17 Drawing Sheets

COMPRESSION STROKE

TROCHOID OIL PUMP

BACKGROUND OF THE INVENTION

1. Field of the Invention

The present invention relates to a trochoid oil pump which enables the endurance to be increased and the reduction of discharge pulsations and noise to be achieved and in which those results can be realized with a very simple structure.

2. Description of the Related Art

Japanese Patent Application Laid-open No. H5-215079 discloses that the space between adjacent contraction chambers and the space between the contraction chamber and a discharge chamber are throttled and a gap capable of linking the chambers is formed between the opposing tooth surfaces in which part of the tooth surface on the rear side in the rotation direction of each tooth of the external-tooth gear or part of the tooth surface on the forward side in the rotation direction of each tooth of the internal-contact gear of an internal-contact gear pump is receded over the entire tooth width.

The technological contents disclosed in Japanese Patent Application Laid-open No. H5-215079 is that the recess is formed by flat surfaces over the entire tooth width in part of the tooth surface of the external-tooth gear or internal-tooth gear. Thus, a flat (linear contour) tooth surface is formed on the inner side of the tooth surface (curved contour) with a curved profile in part of the tooth surface with a curved profile, and a recess is formed over the entire tooth width in the tooth surface (curved tooth profile) of the external-tooth gear or internal-tooth gear by the flat tooth surfaces.

When the gap formed by the flat tooth surfaces reaches the discharge chamber after the appropriate contraction of the contraction chamber on the discharge side, a throttled state is assumed. This is because if the drive contact portions in the tooth surfaces of the external-tooth gear or internal-tooth gear are avoided, the size of the flat portions is very limited and the gap constituted by the flat portions also can be only within a limited range. Part of the liquid present in the contraction chamber is discharged via this gap into the adjacent contraction chamber and discharge chamber, following the reduction in volume of the contraction chamber. However, the size of the gap is not held, while enlarging in the rotation direction, correspondingly to the degree of volume reduction of the contraction chamber, the gap soon becomes throttled and a sufficient link to the adjacent contraction chamber is difficult to provide.

For this reason, the amount of the liquid escaping to the adjacent contraction chamber due to contraction is decreased, the excess pressure increase inside the contraction chamber is difficult to prevent, and the noise induced by cavitation is difficult to suppress. It is an object of the present invention to provide an oil pump in which a sufficient link is ensured between an interdental space in a contraction stroke and an adjacent interdental space preceding the interdental space and a sufficient amount of liquid escapes in the interdental space of the contraction stroke, thereby preventing an excess increase in pressure of the fluid inside the interdental space of the contraction stroke and preventing the occurrence of noise and erosion caused by cavitation.

According to the results of a comprehensive study conducted by the inventors with the object of resolving the above-described problems, the first invention resolves the above-described problems by providing a trochoid oil pump in which an interdental space constituted by an inner rotor and an outer rotor having trochoid tooth profile or substantially trochoid tooth profile starts a compression stroke in a partition section between an intake port and a discharge port, a linking gap is composed by the interdental space and a preceding adjacent interdental space realized in a discharge stroke, and the linking gap expands gradually from the start of the compression stroke to the discharge stroke.

Furthermore, the second invention resolves the above-described problems by providing a trochoid oil pump comprising: a rotor chamber 1 comprising an intake port, a discharge port, and a partition section located between the intake port and discharge port; and an inner rotor and an outer rotor having trochoid tooth profile or substantially trochoid tooth profile, wherein, with an interdental space constituted by the inner rotor and outer rotor starting compression after completion of confinement in the partition section between the trailing end portion of the intake port and the leading end portion of the discharge port, a linking gap that links the interdental space and an interdental space that precedes the interdental space and is adjacent thereto is formed by a region without a contact with the tooth profile 5a of the inner rotor formed between the tooth apex portion and the tooth base portion of the tooth profiles of the outer rotor, and the linking gap gradually expands with the rotation of the rotor.

Furthermore, the third invention resolves the above-described problems by providing a trochoid oil pump comprising: a rotor chamber 1 comprising an intake port, a discharge port, and a partition section located between the intake port and discharge port; and an inner rotor and an outer rotor having trochoid tooth profile or substantially trochoid tooth profile, wherein a concave recess portion is formed between the tooth apex portion and the tooth base portion of the tooth profiles of the outer rotor, the interdental space constituted by the inner rotor and outer rotor forms an intake stroke in the intake port, an intake end stroke and a compression stroke in the partition section, and a discharge stroke in the discharge port, a linking gap produced by the recess portion is formed between the interdental space of the compression stroke and an interdental space in the discharge stroke which is preceding and adjacent with respect to the interdental space, and the linking gap gradually expands with the rotation of the rotor.

Furthermore, the fourth invention resolves the above-described problems by providing a trochoid oil pump of the above-described configuration, wherein the shape of the outer peripheral edge in the contactless region of tooth profile 6*a* of the outer rotor is concaved along a curve in the intermediate portion thereof along a curved line or a circular arc inwardly of the tooth profile. The fifth invention resolves the above-described problems by providing a trochoid oil pump of the above-described configuration, wherein the linking gap maintains continuous expansion from the confinement completion state of the interdental space at least to the compression stroke end state or a state of intersection in the discharge port.

In accordance with the first invention, in the rotation region where the interdental space corresponding to a maximum sealed space is filled with oil (region where cavitation does not occur), the appropriate pressure is released via the linking gap so as to prevent the excess increase in the internal pressure in the interdental space, friction in the rotation drive direction in the tip clearance of the rotor can be reduced and the rotation drive torque can be decreased. Furthermore, in the rotation region where the interdental space that became the maximum sealed space is difficult to fill with oil, the fluid under pressure located in the interdental space adjacent to this interdental space and preceding it in the rotation direction appropriately flows in, thereby making it possible to reduce the difference with the discharge pressure, weaken impacts caused by the difference in pressure, prevent the occurrence of cavitation, and increase the endurance of the product. In addition, drive power loss of the product can be reduced, pulsations can be decreased, and noise can be reduced. The effect of the second invention is almost identical to that of the first invention.

In accordance with the third invention, a concave recessed portion is formed between the tooth apex portion and tooth base portion of the tooth profiles of the outer rotor. As a result, a space of an appropriate size sufficient to constitute the linking gap can be easily formed. Furthermore, because any shape can be produced, various characteristics can be easily set. In accordance with the fourth invention, the recessed portion is concaved along a curve in the intermediate portion thereof along a curved line or a circular arc inwardly of the tooth profile. Therefore, fluid can flow smoothly in the linking gap. In accordance with the fifth invention, the continuous expansion of the linking gap is maintained from the confinement completion state of the interdental space at least to the compression stroke end state or a state of intersection in the discharge port 3. As a result, cavitation can be inhibited, occurrence of erosion can be prevented, and pulsations and noise can be effectively reduced.

DESCRIPTION OF THE PREFERRED EMBODIMENTS

Figure 1A:
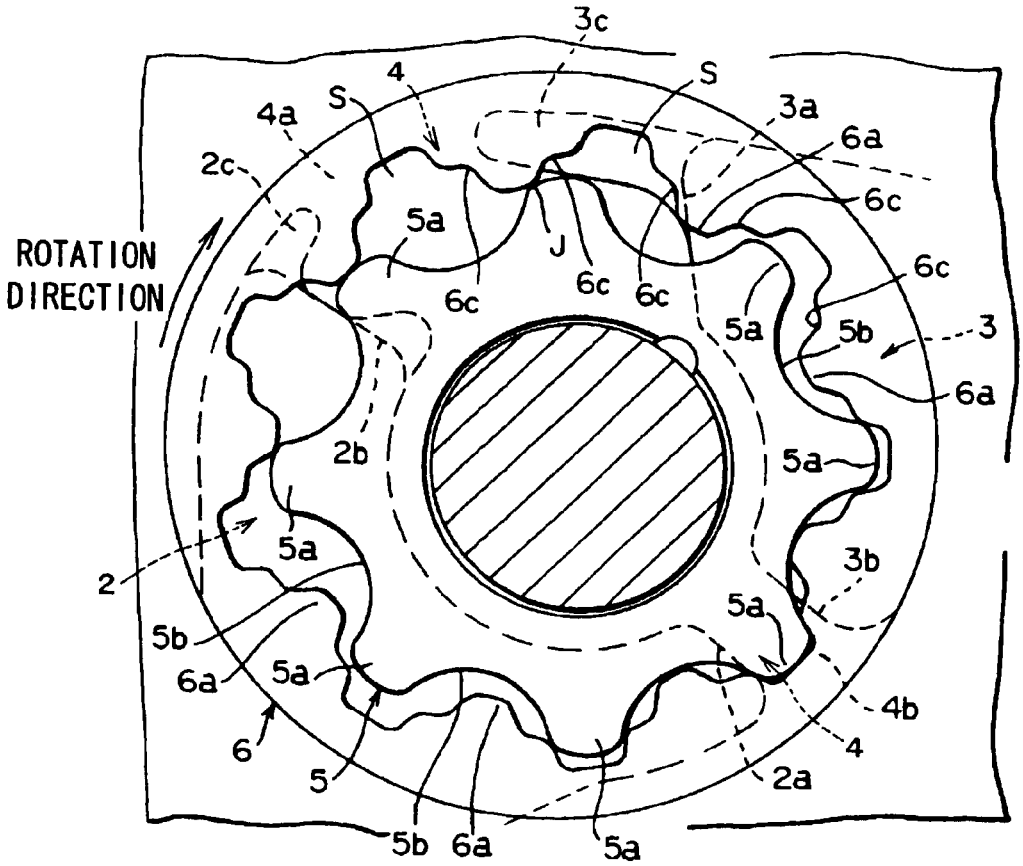
FIG. 1(A) is a front view illustrating the present invention; (B) is an enlarged view in the vicinity of the linking gap in FIG. (A)
Figure 1B:
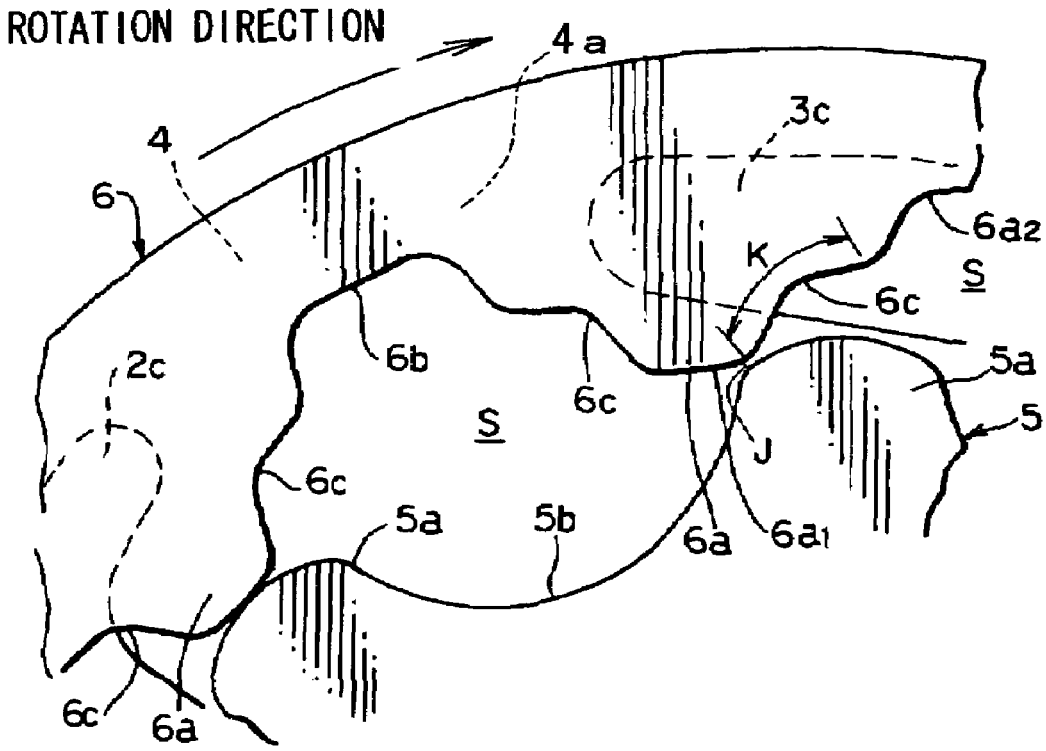
Figure 4:
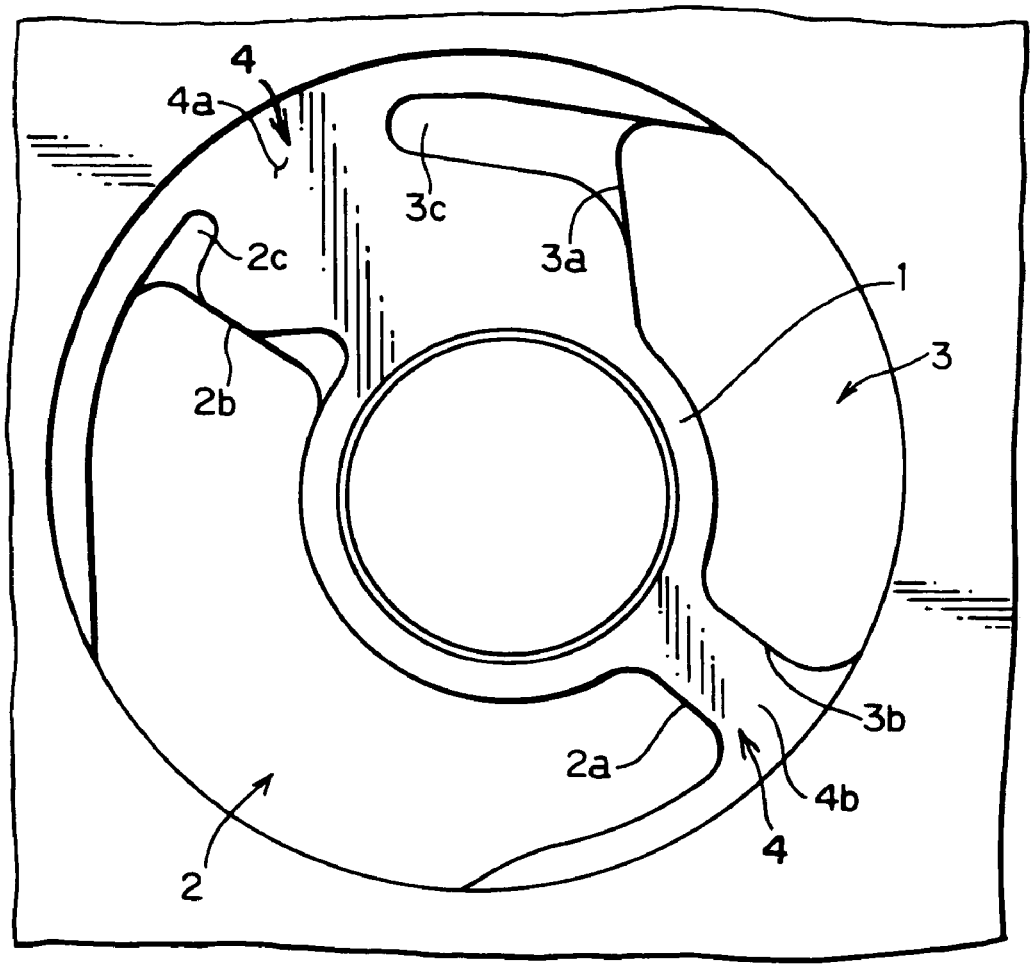
FIG. 4 is a front view of the pump casing.

The best mode for carrying out the invention will be described below with reference to the drawings. In the trochoid pump in accordance with the present invention, as shown in FIG. 1(A), an inner rotor 5 and an outer rotor 6 with a trochoid tooth profile are provided inside a rotor chamber 1 formed inside a pump casing. In the rotor chamber 1, as shown in FIG. 1(A), an intake port 2 and a discharge port 3 are formed almost on the outer periphery along the circumferential direction of the chamber. More specifically, as shown in FIG. 1(A) and FIG. 4(A), the intake port 2 and discharge port 3 have a shape with a left-right asymmetry, and the intake port 2 is formed to have a region surface area larger than that of the discharge port 3.

In the intake port 2, as shown in FIG. 1(A), an interdental space S formed by the rotation of the inner rotor 5 and outer rotor 6 moves, the end portion thereof that is first to reach the region of the intake port 2 becomes the leading end portion 2*a* of the intake port 2, and the end portion that is last to reach the region of the intake port 2 due to rotation of the interdental space S becomes the trailing end portion 2*b*. Similarly, in the discharge port 3, the interdental space S formed by the rotation of the inner rotor 5 and outer rotor 6 moves, the end portion thereof that is first to reach the region of the discharge port 3 becomes the leading end portion 3*a* of the discharge port 3, and the end portion that is last to reach the region of the discharge port 3 due to rotation of the interdental space S becomes the trailing end portion 3*b*.

A protruding linking groove 2*c* is formed from the trailing end portion 2*b* of the intake port 2 along the discharge port 3. Furthermore, in the leading end portion 3*a* of the discharge port 3, a protruding linking groove 3*c* is formed toward the intake port 2. The protruding linking groove 2*c* of the intake port 2 and the protruding linking groove 3*c* of the discharge port 3 are formed as shallow grooves. A configuration without the protruding linking grooves 2*c*, 3*c* or without one of them is also possible.

Partition sections 4 are formed between the intake port 2 and discharge port 3. The partition sections 4 are formed in two places. As shown in FIG. 4(A), one of them is positioned from the trailing end portion 2*b* of the intake port 2 to the leading end portion 3*a* of the discharge port 3, and this partition section 4 is called a first partition section 4*a*. One more partition section 4 is positioned from the trailing end portion 3*b* of the discharge port 3 to the leading end portion 2*a* of the intake port 2 and is called a second partition section 4*b*. The first partition section 4*a* has a flat surface and serves as a cover of the casing and also for the purpose of transferring a fluid to the discharge port 3, while confining the fluid that was taken in from the intake port 2 and fills the interdental space S. The second partition section 4*b* is a partition surface for causing the inner rotor 5 and outer rotor 6 for which the discharge was completed on the side of the discharge port 3 toward the intake port 2.

In the present embodiment, the inner rotor 5 and outer rotor 6 were rotated in the clockwise direction. Furthermore, when the intake port 2 and discharge port 3 are arranged on the left and right side opposite each other, the rotation directions of the inner rotor 5 and outer rotor 6 are counterclockwise directions.

Figure 5:
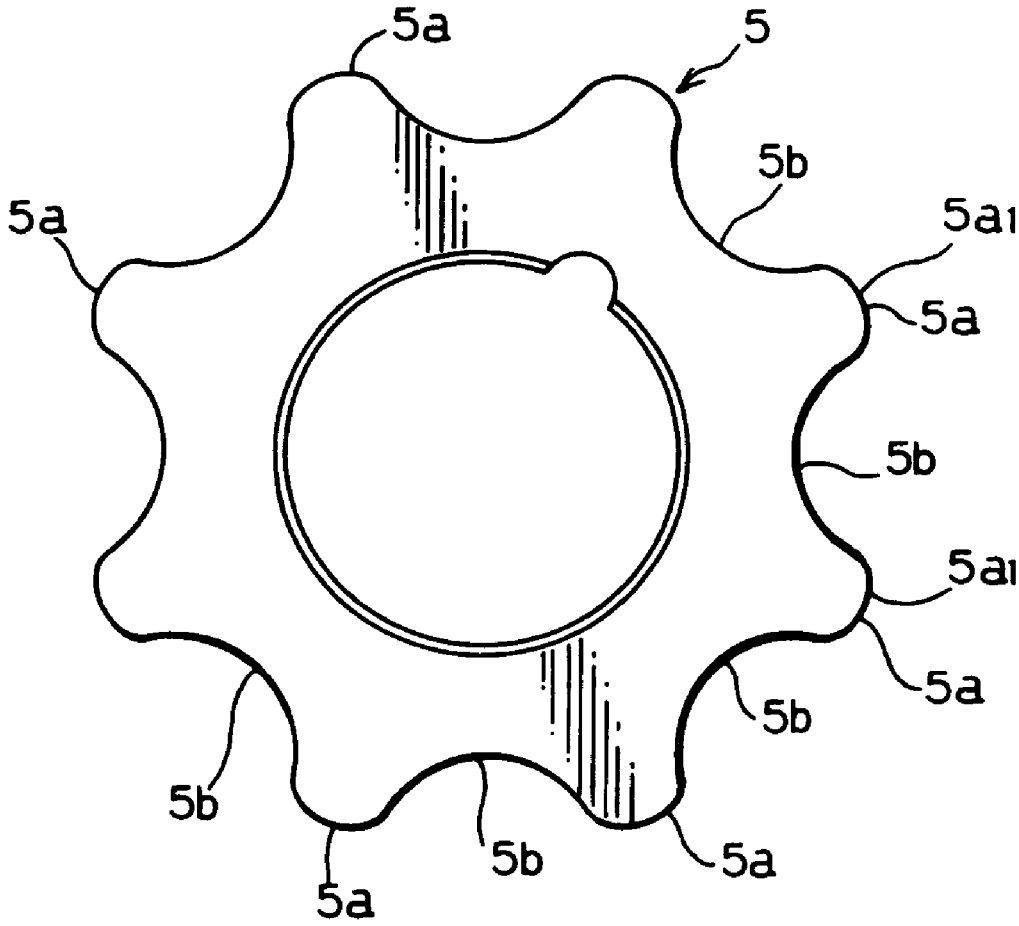
FIG. 5 is a front view of the inner rotor.

The number of teeth in the inner rotor 5 is by one less than that in the outer rotor 6, as shown in FIG. 1(A), and if the inner rotor 5 makes one turn, the outer rotor 6 makes a turn with a delay by one tooth. Thus, the inner rotor 5, as shown in FIG. 5, has a tooth profile 5*a* protruding outwardly and a tooth bottom portion 5*b* concaved inwardly. Similarly, the outer rotor 6 has a tooth profile 6*a* protruding from the inner periphery toward the (rotation) center and a concave tooth bottom portion 6*b*. The inner rotor 5 and outer rotor 6, as shown in FIG. 1(A), are constantly engaged in at least one place, the tooth profile 5*a* of the inner rotor 5 is inserted into the tooth bottom portion 6*b* of the outer rotor 6, and the tooth profile 6*a* of the outer rotor 6 is inserted into the tooth bottom portion 5*b* of the outer rotor 5. The structure may be such that at this time the tooth apex portion $\mathbf{6}a_1$ of the tooth profile 6*a* comes or does not come into contact with the tooth bottom portion 5*b* of the inner rotor 5.

Figure 6A:
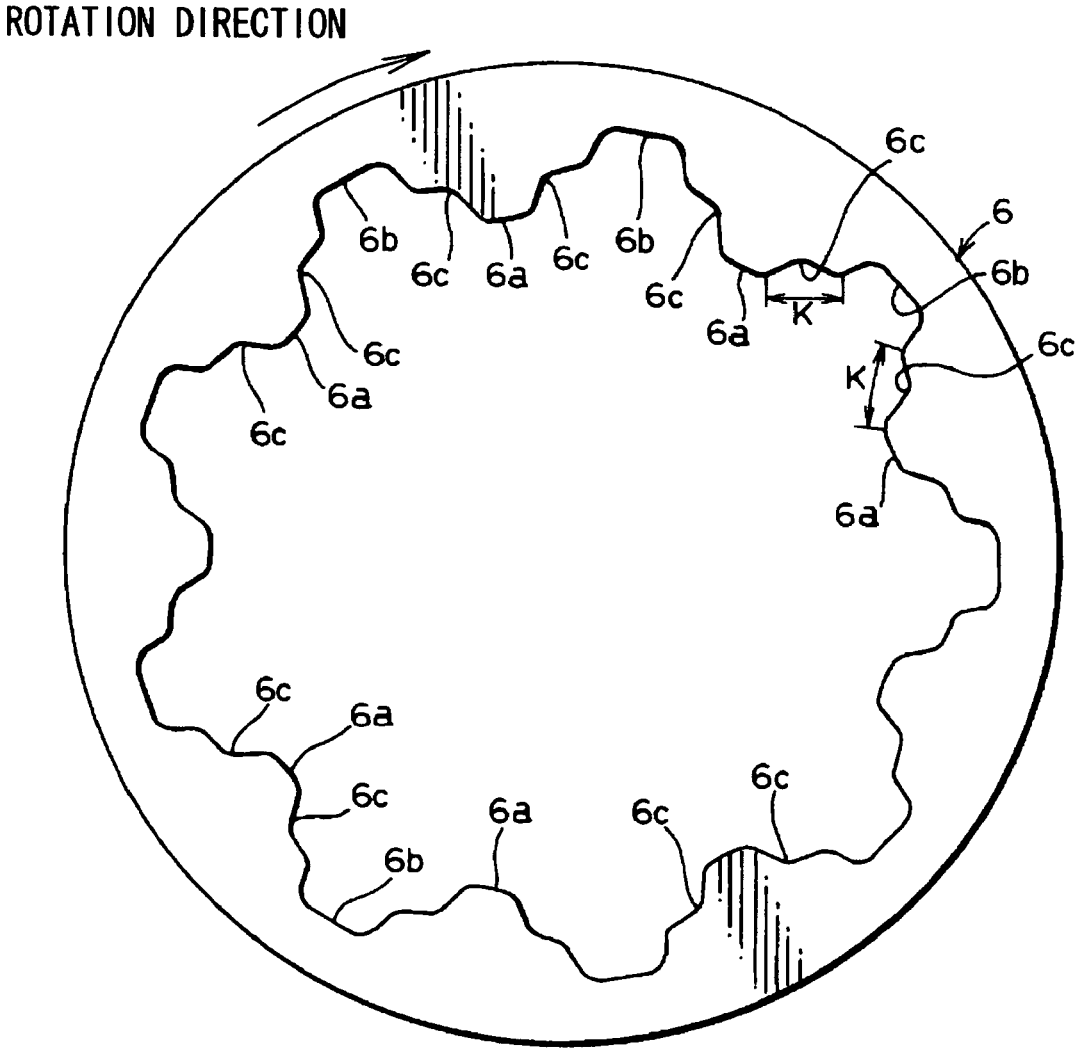
FIG. 6(A) is a front view of the outer rotor, (B)—an enlarged view of the main portion shown in (A)

In the outer rotor 6, as shown in FIGS. 6(A), (B), an apex contact region $T_1$ is set in the tooth apex portion $\mathbf{6}a_1$ as a contact tooth surface that will be engaged with the inner rotor 5, and a base contact region $T_2$ is set in a tooth base portion $\mathbf{6}a_2$. Furthermore, a contactless region K that normally does not come into contact with the tooth profile 5*a* of the inner rotor 5 is formed between the tooth apex portion $\mathbf{6}a_1$ and the tooth base portion $\mathbf{6}a_2$. This contactless region K constitutes the below-described linking gap J in a state where the outer rotor 6 is engaged with the inner rotor 5 and is normally in a state without contact with the tooth profile 5*a* and tooth bottom portion 5*b*. The tooth apex portion $6a_1$ is a distal end portion of the tooth profile 6*a*, and the tooth base portion $6a_2$ is a root portion of the tooth profile 6*a* and can come into contact with the inner rotor 5 in the appropriate range located close to the tooth bottom portion 6*b* on the side surface of the tooth profile 6*a*.

Figure 6B:
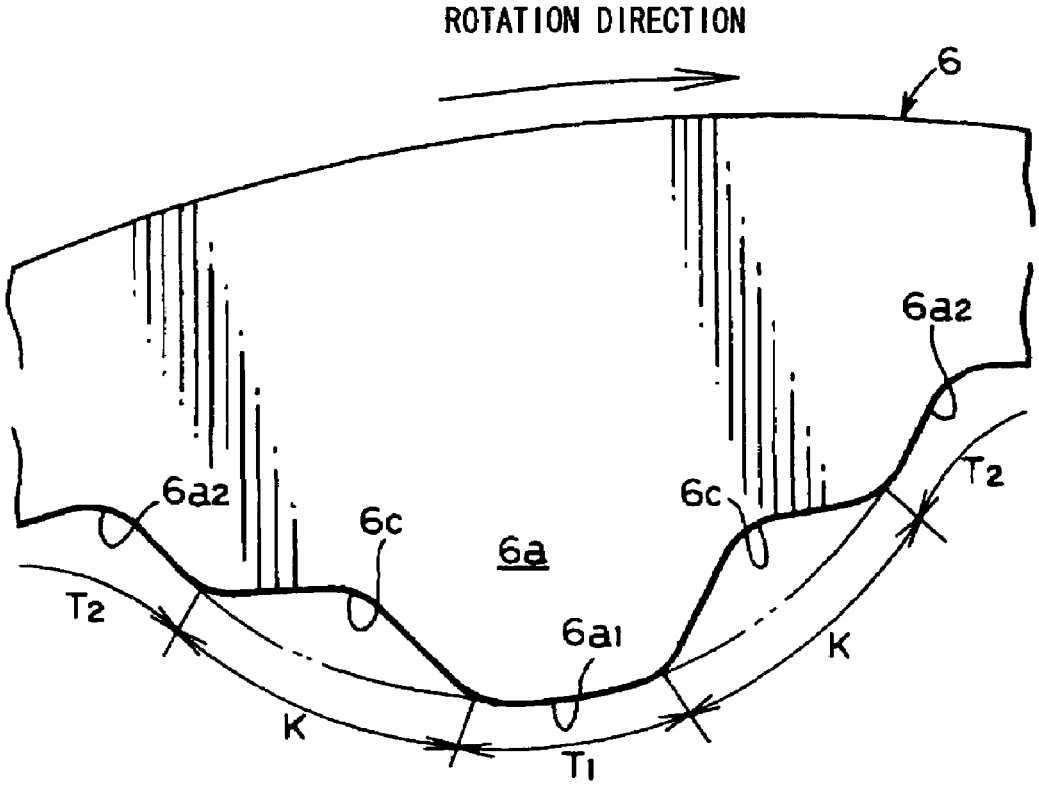

As for the contactless region K of the tooth profile 6*a*, when the contour comprising a circular arc constituting the tooth of the usual outer rotor 6 or the original curve created by the inner rotor a portion indicated by a virtual line (two-dot-dash line) in the tooth profile 6*a* shown in FIG. 6(B) is taken as an outer peripheral edge of the outer rotor tooth profile, the contour of the tooth profile 6*a* is formed on the inner side of this outer peripheral edge of the outer rotor tooth profile. That is, the contour shape of the side surface of the tooth in the contactless region K is a curve different from that of the contour obtained when the outer rotor 6 is formed along the usual circular arc or original curve created by the inner rotor 5. This contactless region K is set in the location of the side surface in the tooth thickness direction of the tooth profile 6*a* of the outer rotor 6 and set on the entire side surface in the tooth width direction. Furthermore, the tooth thickness direction of the tooth profile 6*a* as referred to herein is the direction shown along the rotation direction of the outer rotor 6, and the tooth width direction is the direction along the axial direction of the outer rotor 6 direction perpendicular to the sheet surface in FIG. 6(A).

The curve shape in the contactless region K is a free curve combining circular arcs or any curves, or a curve represented by an algebraic equitation (algebraic curve), or a composite curved obtained by appropriately combining those curves. The circular arcs thereof may be infinite circular arcs. If the curve is represented by an algebraic equation, the degree thereof is preferably 2 to 5. The contactless region K of the outer rotor 6 is formed by the above-described curve different from the usual circular arc or original curve created by the inner rotor 5, and forms a contour maintaining a contactless state in engagement with the tooth profile 5*a* comprising the usual trochoid curve of the inner rotor 5 engaged with the outer rotor 6.

Furthermore, the tooth apex portion $6a_1$ and tooth base portion $6a_2$ become the regions that come into contact with the tooth profile Sa of the inner rotor 5. More specifically, the tooth apex portion $6a_1$ has an apex contact region $T_1$ and becomes a site that comes into contact with the tooth profile 5*a* of the inner rotor 5. Likewise, the tooth base portion $6a_2$ becomes a site that comes into contact with the tooth profile 5*a* of the inner rotor 5. The apex contact region $T_1$ and base contact region $T_2$ do not necessarily always come into contact with the tooth profile 5*a* at the same time. Any one of the apex contact region $T_1$ and base contact region $T_2$ of the tooth profile 6*a* also may be in contact with the tooth profile 5*a*. In particular, when the inner rotor 5 is rotated by the drive source and transmits the rotation to the outer rotor 6, the apex contact region $T_1$ and base contact region $T_2$ are the sites where the tooth profile 6*a* of the outer rotor 6 comes into contact with the tooth profile 5*a* of the inner rotor 5 and the sites that receive a rotation force from the 5*a*.

Thus, the contactless region K, which does not come into contact with the inner rotor 5, is provided on the tooth surface of the tooth profile 6*a* of the outer rotor 6 and the inner rotor 5 has a tooth profile 5*a* comprising the usual trochoid curve, in particular, no region equivalent to the contactless region K is provided on the inner rotor 5. Furthermore, when the outer rotor 6 and inner rotor 5 are assembled inside the pump chamber of an oil pump, only the tooth apex portion $6a_1$ and the tooth base portion $6a_2$ of the outer rotor 6 come into contact with the outer peripheral edge of the tooth profile 5*a* formed by the trochoid curve of the inner rotor 5, as the inner rotor is rotary driven and the tooth profile 5*a* of the inner rotor 5 is engaged with the tooth profile 6*a* of the outer rotor 6.

Furthermore, the interdental spaces S, S, . . . constituted by the tooth profiles 5*a* and tooth bottom portions 5*b* of the inner rotor 5 and the tooth profiles 6*a* and tooth bottom portions 6*b* of the outer rotor 6 are linked by the gap portions created by the contactless region K in the intake port 2 and discharge port 3 of the pump housing, and a maximum sealed space $S_{max}$ comprising the outer rotor 6 and inner rotor 5 is configured in the first partition section 4*a* provided between the intake port 2 and discharge port 3. The maximum sealed space $S_{max}$ is constituted by a sealed interdental space S formed in a sealed state by the first partition section 4*a* between the intake port 2 and discharge port 3, and the volume of the maximum sealed space $S_{max}$ differs depending on the formation arrangement of the trailing end portion 2*b* of the intake port 2 and leading end portion 3*a* of the discharge port 3.

Figure 7A:
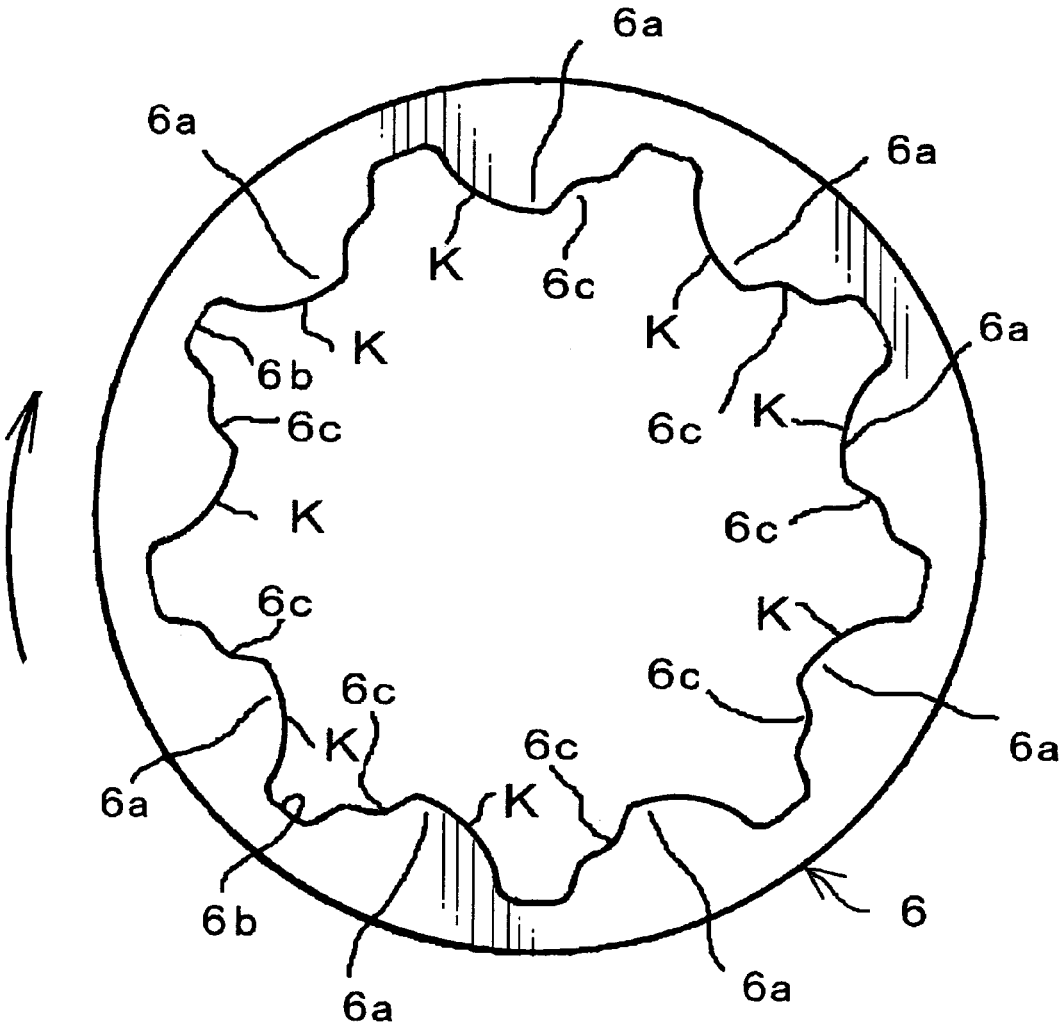
FIG. 7(A) is a front view illustrating another embodiment of the outer rotor, (B)—an enlarged view of the main portion shown in (A)
Figure 7B:
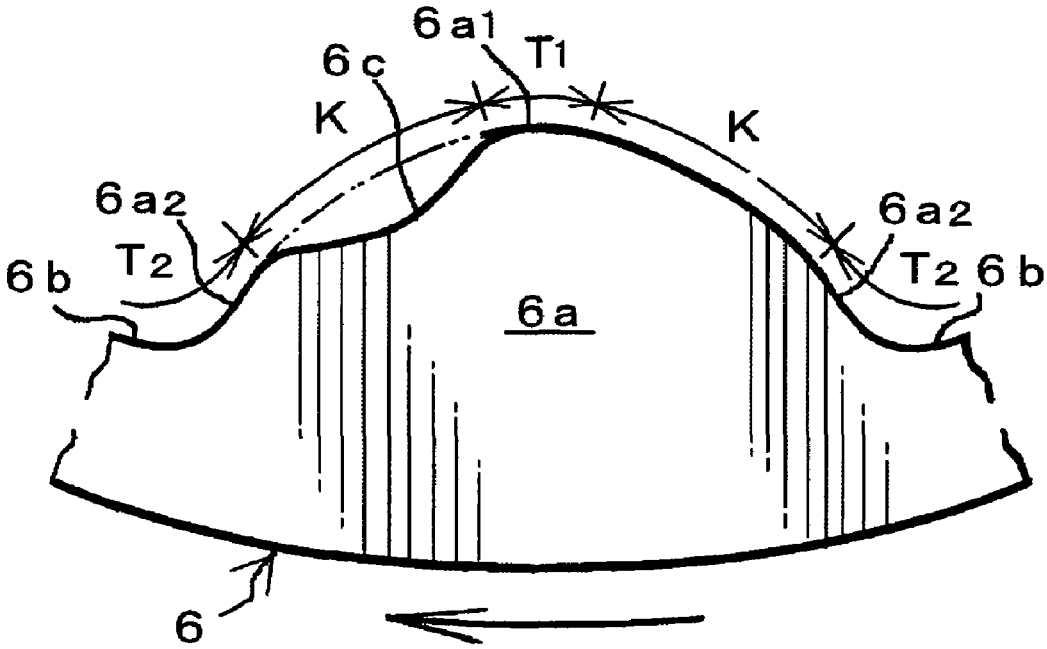

As for the shape of the contactless region K, as shown in FIGS. 6(A), (B) and in FIGS. 7(A), (B), this region is formed so as to become concave inward of the tooth profile 6*a* on the surface at least in the forward location in the rotation direction of the outer rotor 6, and this concave section is specifically called a depressed section 6*c*. Thus, this region is formed so as to be drawn in to a larger depth inwardly in the tooth thickness direction of the tooth profile 6*a* from the trochoid original curve of the tooth profile 6*a*. The depressed section 6*c* provides an even larger spacing between the contactless region K of the tooth profile 6*a* and the tooth profile 5*a* of the inner rotor 5, and this spacing site serves as a linking gap J with a gap width that can be changed by the rotation of the rotor.

As for a specific shape of the depressed section 6*c*, it can be formed as an arc or curve inward of the tooth profile 6*a*. Employing such a shape makes it possible to increase gradually the gap, i.e., the linking gap J, between the tooth profile 6*a* and the tooth apex portion $5a_1$ of the tooth profile 5*a* of the inner rotor 5 passing through the contactless region K of the tooth profile 6*a* when the interdental space S constituting the maximum sealed space $S_{max}$ changes gradually in the compression process in which the volume thereof decreases in the first partition portion 4*a* (see FIG. 3). Furthermore, the depresses section 6*c* can be also formed to have a shape with left-right symmetry on both sides in the tooth thickness direction, with the tooth profile 6*a* as a center, and such shape is actually most often used [see FIGS. 6(A), (B)].

The operation of the present invention will be explained below based on FIG. 2 and FIG. 3. First, the interdental space S formed by the engagement of the outer rotor 6 and inner rotor 5 with a trochoid or almost trochoid tooth profile takes part in the four pump strokes: intake [see FIG. 2(A)], intake end [see FIG. 2(B)], compression [see FIG. 2(C)], and discharge [see FIG. 2(D) or (E)] in the location of the first partition portion 4*a*, as a fluid passes from the intake port 2 via the first partition portion 4*a* toward the discharge port 3. Thus, there are generally four pump strokes: an intake stroke of the intake port 2, confining the fluid that was sucked in the partition portion 4 (maximum sealed space $S_{max}$), a compression stroke (rotation on the discharge side, the interdental space is in a state where it is not directly linked to the discharge port or the linking groove of the discharge port), and a discharge stroke of the discharge port 3. Those four strokes will be denoted by the symbols intake stroke $P_1$, intake end stroke $P_2$, compression stroke $P_3$, and discharge stroke $P_4$.

The interdental space S of the four strokes will be described below. In the intake stroke $P_1$, oil is sucked in from the intake port 2 by expanding the volume of the interdental space S between the inner rotor 5 and outer rotor 6. In the intake end stroke $P_2$, the interdental space S moves from the intake port 2 to the first partition section 4*a* and becomes a sealed space. Then, in the compression stroke $P_3$, the interdental space S between the outer rotor 6 and inner rotor 5 moves from the state where it became the sealed space upon completion of the intake end stroke $P_2$ in the first partition section 4*a* toward the discharge port 3, and the reduction in this volume creates a compressed state. This state is not directly open in the discharge port 3 or the protruding linking groove 3*c* of the discharge port 3. Then, in the discharge stroke $P_4$, the interdental space S is linked to the discharge port 3 or the protruding linking groove 3*c* of the discharge port 3, and the oil is discharged into the discharge port 3, following decrease in the volume of the interdental space S.

The tooth profile 5*a* of the inner rotor 5 in the oil pump in accordance with the present invention has a tooth surface of the usual trochoid tooth profile. Furthermore, a linking gap J of variable size is constituted between the interdental space S and the preceding adjacent interdental space S in the rotor rotation direction within the interval from the compression stroke $P_3$ to the discharge stroke $P_4$ of the interdental space S. This linking gap J is included in a concept of the usual tip clearance. However, the usual tip clearance is designed to provide for smooth rotation of the inner rotor 5 and outer rotor 6, whereas the linking gap J serves to provide for a through flow of the fluid between the interdental space S and the preceding adjacent interdental space S.

Figure 3A:
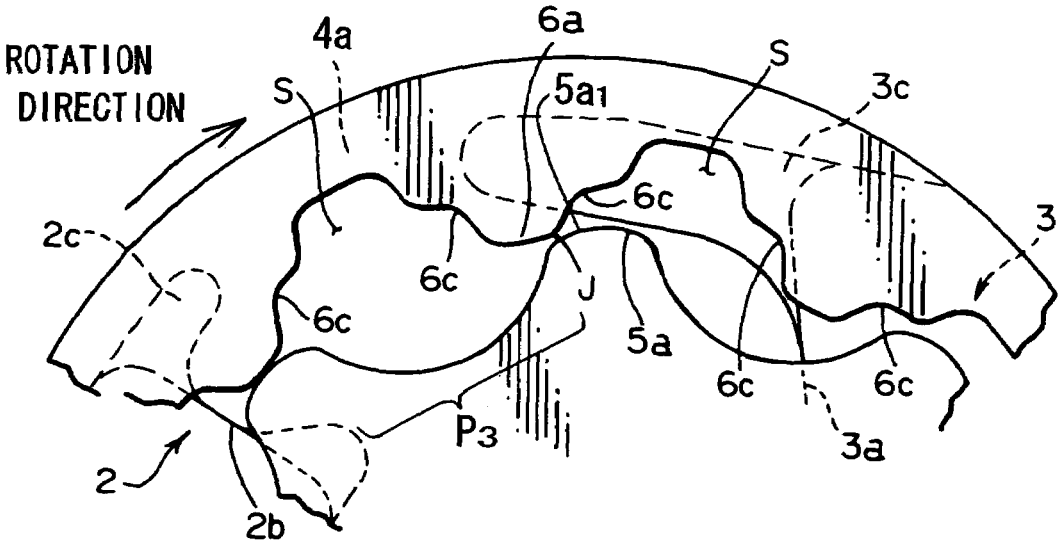
FIG. 3(A) through (C) are operation diagrams illustrating the gradual expansion of the linking gap.
Figure 3B:
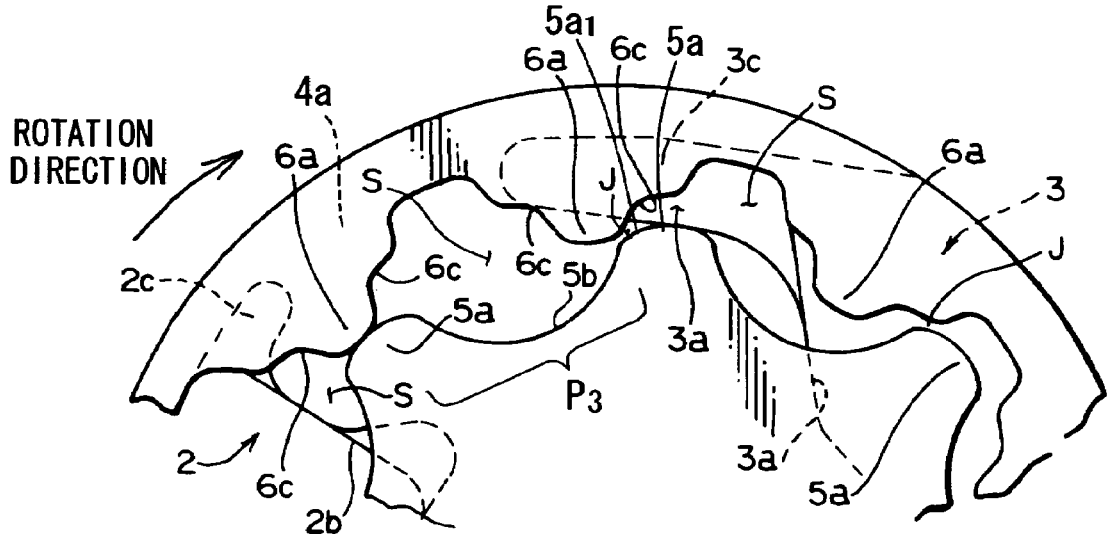
Figure 3C:
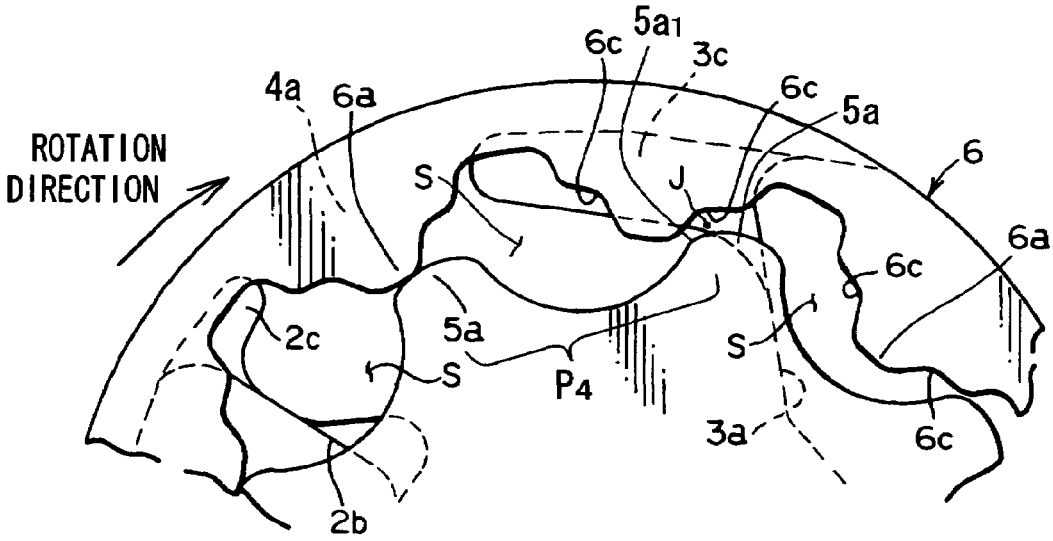

As the interdental space S enters the operation state of the compression stroke $P_3$ in the location of the first partition section 4*a*, the linking gap J starts to expand gradually, as shown in FIGS. 3(A) through (C), and forms fluid channels through which the fluid is pumped out from the interdental space S positioned in the region of the compression stroke $P_3$ to the preceding adjacent interdental space S or, reversely, flows from the preceding adjacent interdental space S into the interdental space S. Because the linking gap J changes so as to expand gradually following the rotation direction of the rotor, the amount of fluid flowing into the preceding adjacent interdental space S can be gradually increased and the fluid can be appropriately caused to flow into the interdental space S.

Figure 2A:
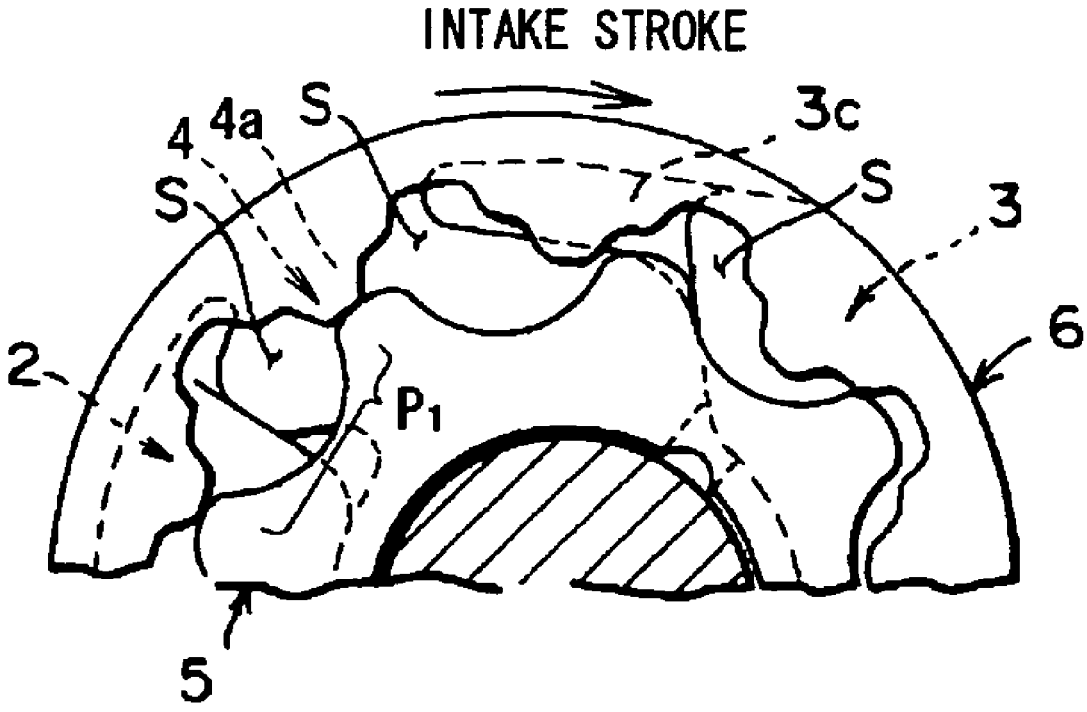
FIG. 2(A) illustrates an intake stroke, (B)—an intake end stroke, (C)—illustrates a compression stroke, (D)—illustrates a state where a discharge stroke is started, and (E)—illustrates a discharge stroke.
Figure 2B:
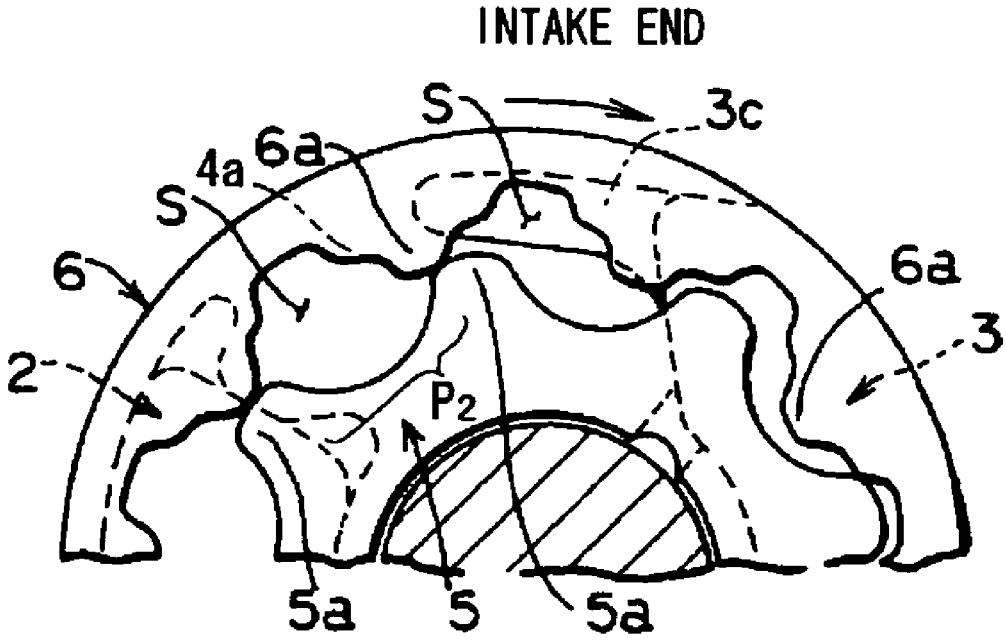
Figure 2C:
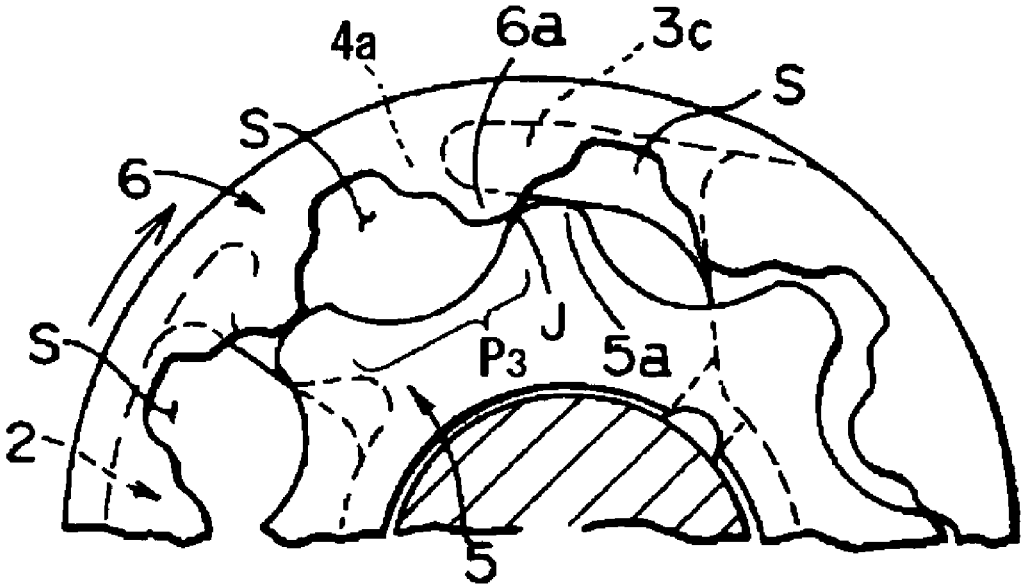
Figure 2D:
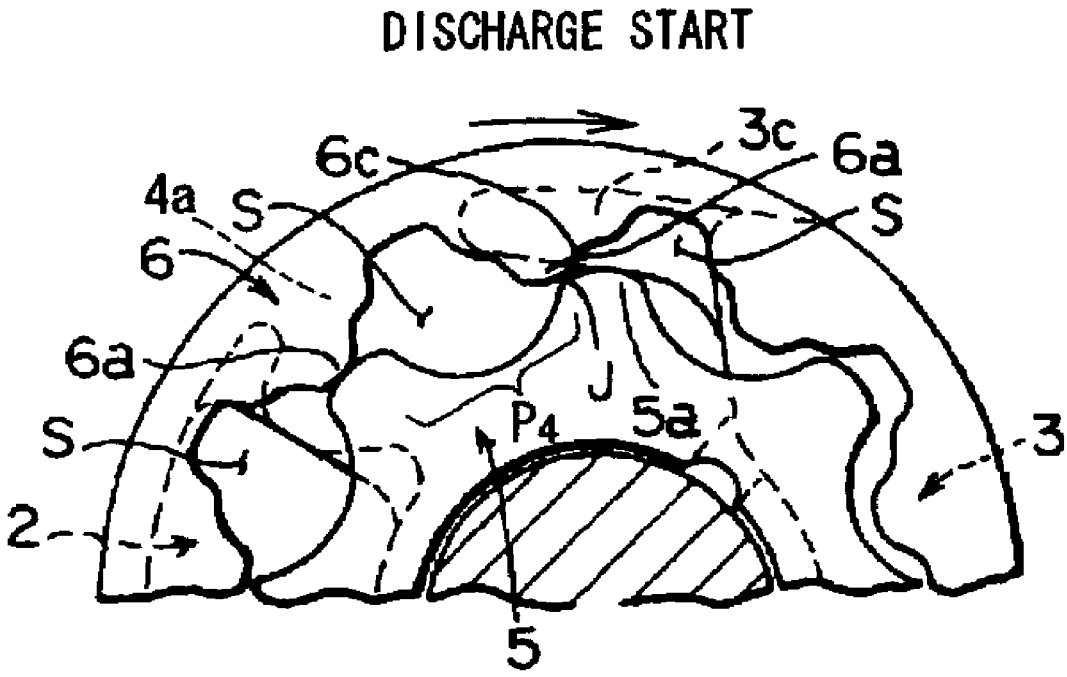
Figure 2E:
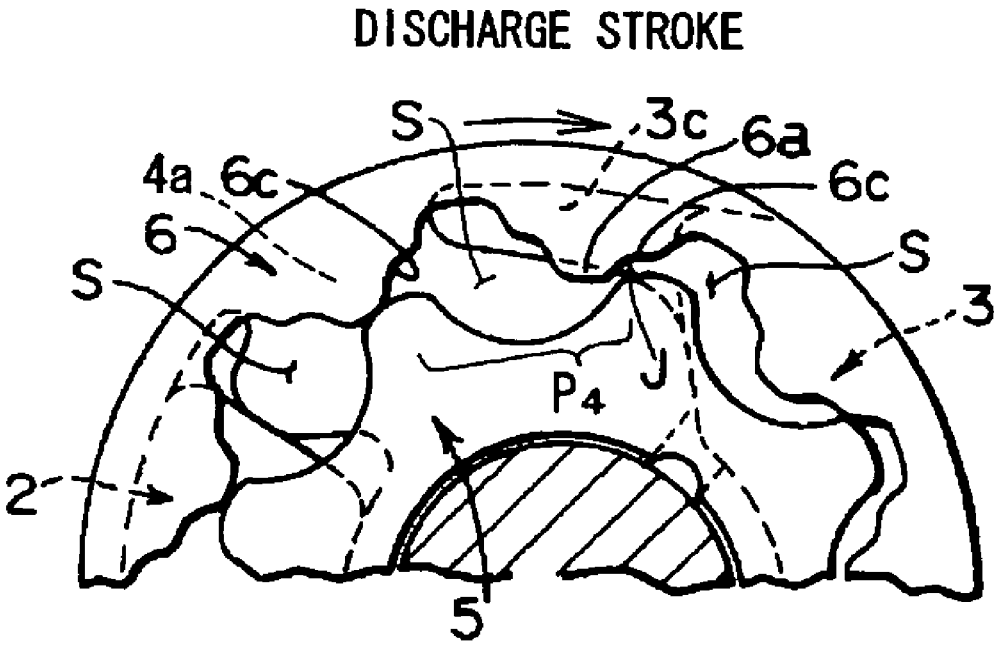

When the interdental space S enters the compression stroke $P_3$, as shown in FIG. 2(C) and FIG. 3(A), because the preceding adjacent interdental space S has already been opened and linked to the discharge port 3 or the protruding linking groove 3*c* of the discharge port 3, and a state has been assumed in which the fluid was discharged from the preceding adjacent interdental space S to the discharge port 3, the fluid from the interdental space S in the compression stroke $P_3$ also can be smoothly pumped into the preceding adjacent interdental space S. Furthermore, the fluid can be also appropriately caused to flow under pressure from the preceding adjacent interdental space S to the interdental space S. Such an expansion operation of the linking gap J will be maintained in the vicinity of the discharge start position of at least the interdental space S in the discharge port 3 or the protruding linking groove 3*c* of the discharge port 3 (see FIG. 2(E), FIG. 3(C), etc.). Thus, it is preferred that the linking gap J expand gradually and continuously as the interdental space S makes a transition from the start position of the compression stroke $P_3$ to the start position of the discharge stroke $P_4$.

However, the interdental space S may also slightly decrease the linking gap J from before the start position of the discharge stroke $P_4$. In this case, this decrease is assumed to produce no large effect on friction in the rotation drive direction in the compression stroke. The linking gap J is preferably within 10% of the maximum gap of the variable tip clearance.

In the rotation region in which the interdental space S is in the first partition section 4*a*, the intake end stroke $P_2$ has ended and the maximum sealed space $S_{max}$ is completely filled with the fluid, that is, in the rotation region where no capitation occurs, the pressure of the fluid confined in the interdental space S rises to increase the internal pressure of the interdental space S, but the linking gap J serves to prevent an excess rise of the internal pressure. Thus, the excess pressure of the interdental space S can be appropriately released into the preceding adjacent interdental space S from the linking gap J, thereby reducing the difference with the discharge pressure. Furthermore, friction in the drive rotation direction of the outer rotor 6 and inner rotor 5 can be reduced and the rotation drive torque can be prevented from increasing.

When the internal pressure of the interdental space S is released into the discharge port 3 by gradual expansion of the linking gap J between the interdental space S and the preceding adjacent interdental space S in the compression stroke from the intake end of the maximum sealed state space of the interdental space S, compression is increased and the internal pressure rises in the rotation direction of the rotor, but the linking gap J also gradually expands, the release of pressure is conducted slowly in a timely manner, and the occurrence of excess pressure increase in the interdental space S can be prevented. Furthermore, in the rotation region where the maximum sealed space $S_{max}$ is difficult to fill completely with the fluid, that is, in the region where cavitation easily occurs, the fluid under an appropriate pressure can be appropriately caused to flow into the interdental space S via the linking gap J by the adjacent preceding interdental space S. As a result, erosion, vibrations, and noise caused by collapse of cavitation induced by rapid inflow of the fluid from the discharge port 3 can be prevented.

Because the linking gap J is then gradually and continuously expanded in the discharge stroke $P_4$ of the interdental space S, the linking state of the adjacent preceding interdental space S with the interdental space S is enlarged, the difference in pressure between the interdental space S in the discharge stroke $P_4$ where it is linked and opened to the discharge port 3 or the protruding linking groove 3*c* of the discharge port 3 and the preceding adjacent interdental space S can be reduced by adjustment, rapid increase in pressure can be prevented and pulsations and noise can be reduced.

Figure 8:
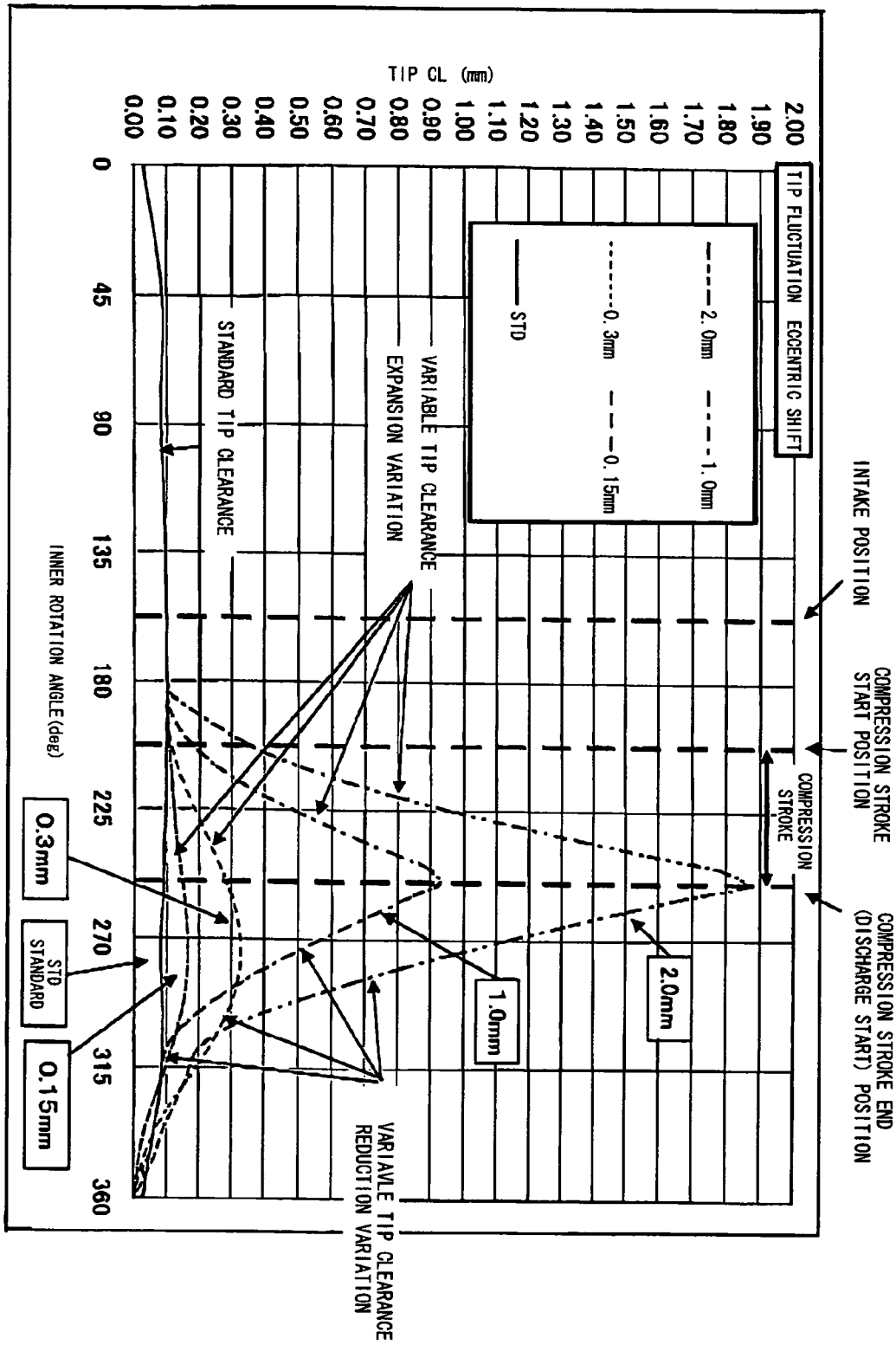
FIG. 8 is a graph illustrating the characteristic in accordance with the present invention.

A specific example of the linking gap J will be explained below with a graph shown in FIG. 8. A tip clearance that is normally set for the inner rotor 5 and outer rotor 6 is taken as a standard tip clearance. The size thereof is taken, for example, as 0.10 mm. In the intake stroke $P_2$ to compression stroke $P_3$, this value is about 1.3 times the standard tip clearance for the linking gap J provided between the leading side in the rotation direction of the tooth profile 6*a* of the outer rotor 6 and the rear side in the rotation direction of the tooth profile 5*a* of the inner rotor 5.

This value will be described below in greater detail. In the start position of the compression stroke $P_3$ of the interdental space S, the linking gap J becomes about 1.3 times the standard tip clearance, and the linking gap J in the start position of the discharge stroke $P_4$ after this start position of the compression stroke $P_3$ is about 1.5 times the standard tip clearance. Thus, the linking gap J starts from about 1.3 times or more of the standard tip clearance in the start and end positions of the compression stroke $P_3$ and can continuously expand and change to a size of about 1.5 times or more (discharge start position). Therefore, it is preferred that the linking gap J constituted over the intake end stroke $P_2$, compression stroke $P_3$, and discharge stroke $P_4$ can enlarge continuously the appropriate linking quantity from 0.1 to 2.0 mm.

This preferred range will be described below in greater detail. In the start position of the compression stroke $P_3$ of the interdental space S, the linking gap J is taken within a range of about 1.3 to 10 times the standard tip clearance, and in the star position of the discharge stroke $P_4$ after the compression stroke $P_3$, the linking gap J is within a range of about 1.5 to 20 times the standard tip clearance. Furthermore, in accordance with the present invention, the linking gap J preferably can continuously enlarge and change the appropriate link quantity from 0.1 to 2.0 mm, as described hereinabove, but this range is not particularly limiting, and the liking gap J can be such as to obtain a variety of oil pump characteristics by slowing or accelerating the expansion variation by changing in a variety of ways the size of the depressed section 6*c* in the above-described contactless region K. Whether this variation of the linking gap J is slow or fast, the linking gap J should be varied with respect to the standard tip clearance so as to expand continuously in the compression process $P_3$. In the graphs with 0.3 mm and 0.15 mm in FIG. 8, a maximum gap of the variable tip clearance was provided on the discharge side (right side on the graph) from the end position of the compression process $P_3$.

The variation trend of the linking gap J with respect to the standard tip clearance can be variously set depending on the oil pump. Thus, the variability of the linking gap J can be variously set by the number of teeth or characteristics of the rotor or the size of the oil pump so that the variation quantity increases and the gradient of change increases, or conversely that the variation quantity decreases and the gradient of change decreases with respect to a graph line for which the aforementioned variation state expands gradually with a small gradient.

The linking gap J is appropriately set to vary so as to expand or to vary so as to decrease within a range in which the interdental space S is appropriately opened to the discharge port 3 or the protruding linking groove 3*c* of the discharge port 3 in the discharge stroke $P_4$. Furthermore, it is also sometimes caused to reduce slightly before the start of the discharge stroke $P_4$. However, in this case, because the linking gap J will be decreased in the compression stroke $P_3$, it is taken to be such as to produce no large effect on friction in the rotation drive direction. In this case, the reduction variability within about 10% of the maximum gap of the linking gap J is preferred.

Furthermore, when the protruding linking groove 3*c* is formed in the discharge port 3, the linking gap J is preferably not linked or open to the discharge port 3 in the compression stroke $P_3$. Thus, before the interdental space S is open to the protruding linking groove 3*c*, it is linked to the discharge side only from the linking gap J of the interdental space S.

The movement of the linking gap in the rotation region of the oil pump will be explained below. When the interdental space S is the maximum sealed space $S_{max}$, in the rotation region in which this interdental space S is filled with oil (region in which cavitation does not occur; sometimes in the case of low-speed rotation), the pressure is appropriately released from the linking gap J so that the internal pressure of the interdental space S does not become too high, friction in the rotation drive direction in the tip clearance of the rotor can be reduced, and the rotation drive torque can be reduced.

Furthermore, in the rotation region in which the interdental space S is the maximum sealed space $S_{max}$ and is difficult to fill completely with oil (region in which cavitation easily occur; sometimes in the case of high-speed rotation), the volume efficiency of the interdental space S becomes low due to cavitation, the internal pressure of the interdental space S decreases, the fluid appropriately flows under pressure from the discharge side, and the difference with the discharge pressure can be reduced. Thus, the fluid under pressure present in the preceding adjacent interdental space S flows appropriately into the interdental space S via the linking gap J, thereby making it possible to reduce the difference with the discharge pressure, weaken impacts caused by the difference in pressure, and prevent the occurrence of erosion. In addition to the above-described effect, the endurance of the product can be increase. Moreover, drive power loss of the product can be reduced, pulsations can be decreased, and noise can be reduced.

What is claimed is:

1. A trochoid oil pump in which an interdental space constituted by an inner rotor and an outer rotor that meshes with the inner rotor, both the inner rotor and outer rotor having a trochoidal tooth profile or a substantially trochoidal tooth profile which forms a sealed space in a partition section between a trailing end portion of an intake port and a leading end portion of a discharge port or a protruding linking groove formed as a shallow groove from the start portion of the discharge port to the intake port side, wherein a compression stroke in which the interdental space constituting the sealing space in the partition section is moved toward the discharge port side and a volume of the interdental space reduces to form a compressed state and form a state in which the interdental space does not directly open to the discharge port or the protruding linking groove of the discharge port is established, wherein a linking gap variable by a rotation of the rotor such that a width of a relative gap between the tooth profile of the inner rotor and the tooth profile of the outer rotor gradually expands in the compression stroke in the partition section is provided so as to be constituted between the interdental space of the compression stroke in the partition section and a succeeding interdental space already opened and linked to the discharge port or the protruding linking groove of the discharge port, the linking gap causing a fluid to flow between the succeeding interdental space and the interdental space of the compression stroke in the partition section, wherein the operation for expanding the linking gap is maintained to at least a vicinity of a discharge start position of the discharge port of the interdental space of the compression stroke or the protruding linking groove of the discharge port, and wherein the interdental space having passed through the compression stroke opens and links to the discharge port or the protruding linking groove of the discharge port.

2. The trochoid oil pump according to claim 1, wherein a shape of an outer peripheral edge in the contactless region with the tooth profile of the inner rotor formed between the tooth apex portion and the tooth base portion of the tooth profile of said outer rotor is defined by a recess portion with a concavely curved intermediate portion formed inwardly of the tooth profile in a curved shape or a substantially circular arc shape.

3. The trochoid oil pump according to claim 2, wherein said linking gap maintains continuous expansion from a confinement completion state of the interdental space to at least the compression stroke end state where there is no direct opening in the interdental space of the compression stroke to the discharge port or the protruding linking groove of the discharge port or a state of intersection in the discharge port or the protruding linking groove of the discharge port.

4. The trochoid oil pump according to claim 1, wherein the linking gap maintains continuous expansion from a confinement completion state of said interdental space to at least the compression stroke end state, where there is no direct opening in the interdental space of the compression stroke to the discharge port or the protruding linking groove of the discharge port, or a state of intersection in the discharge port or the protruding linking groove of the discharge port.

5. The trochoid pump of claim 1, wherein a number of teeth of the inner rotor is one tooth less than a number of teeth of the outer rotor.

6. The trochoid pump of claim 1, wherein the inner rotor and the outer rotor are engaged at at least one portion.

7. The trochoid pump of claim 1, wherein a rotation of the outer rotor is delayed from a rotation of the inner rotor by a rotational amount equivalent to one tooth.

8. The trochoid pump of claim 1, wherein the contactless region is formed in a side surface of the tooth thickness direction of the tooth profile of the outer rotor.

9. The trochoid pump of claim 1, wherein the contactless region is formed as a curved portion opposite an associated arc portion of a tooth of the inner rotor to not engage the inner rotor.

10. The trochoid pump of claim 1, wherein an interdental space formed between the inner rotor and the outer rotor is linked by a gap portion formed by the contactless region at the intake port.

11. The trochoid pump of claim 1, wherein an interdental space formed between the inner rotor and the outer rotor is linked by a gap portion formed by the contactless region at the discharge port.

12. The trochoid pump of claim 1, wherein the interdental space comprises a first partition section, and wherein the inner rotor and the outer rotor form a maximum sealed spaced therebetween at the first partition section provided between the intake port and the discharge port.

13. The trochoid pump of claim 1, wherein a depressed portion of the contactless region is formed to have a symmetry on both sides in the tooth thickness direction.

14. A trochoid oil pump in which an interdental space, constituted by an inner rotor and an outer rotor that meshes with the inner rotor, both the inner rotor and outer rotor having a trochoidal tooth profile or a substantially trochoidal tooth profile which forms a sealed space in a partition section between a trailing end portion of an intake port and a leading end portion of a discharge port or a protruding linking groove formed as a shallow groove from the start portion of the discharge port to the intake port side, wherein a contactless region with the tooth profile of the inner rotor formed between a tooth apex portion and a tooth base portion of the tooth profile of the outer rotor is provided, wherein a compression stroke in which the interdental space constituting the sealing space in the partition section is moved toward the discharge port side and a volume of the interdental space reduces to form a compressed state and form a state in which the interdental space does not directly open to the discharge port or the protruding linking groove of the discharge port is established, wherein a linking gap that is variable by rotation of the rotor such that a width of a relative gap between the contactless region of the outer rotor and the tooth profile of the inner rotor gradually expands in the compression stroke in the partition section is established so as to be defined between the interdental space of the compression stroke in the partition section and a succeeding interdental space already opened and linked to the discharge port or the protruding linking groove of the discharge port, wherein the linking gap causes a fluid to flow between the succeeding interdental space and the interdental space of the compression stroke in the partition section.

wherein the operation for expanding the linking gap is maintained to at least a vicinity of a discharge start position of the discharge port of the interdental space of the compression stroke or the protruding linking groove of the discharge port, and wherein the interdental space having passed through the compression stroke opens and links to the discharge port or the protruding linking groove of the discharge port.

15. The trochoid oil pump according to claim 14, wherein a shape of an outer peripheral edge in the contactless region with the tooth profile of the inner rotor formed between the tooth apex portion and the tooth base portion of the tooth profile of said outer rotor is defined by a recess portion with a concavely curved intermediate portion formed inwardly of the tooth profile in a curved shape or a substantially circular arc shape.

16. The trochoid oil pump according to any claim 14, wherein the linking gap maintains continuous expansion from a confinement completion state of the interdental space to at least the compression stroke end state where there is no direct opening in the interdental space of the compression stroke to the discharge port or the protruding linking groove of the discharge port or a state of intersection in the discharge port or the protruding linking groove of the discharge port.

17. A trochoid oil pump in which an interdental space formed by an inner rotor and an outer rotor that meshes with the inner rotor, both the inner rotor and outer rotor each having a trochoidal tooth profile or a substantially trochoidal tooth profile which forms a sealed space in a partition section between a trailing end portion of an intake port and a leading end portion of a discharge port or a protruding linking groove formed as a shallow groove from the start portion of the discharge port to the intake port side, wherein a contactless region with the tooth profile of the inner rotor formed between a tooth apex portion and a tooth base portion of the tooth profile of the outer rotor is formed with a concave recess portion formed inwardly of the tooth profile of the outer rotor in at least a front-side face with respect to a direction of rotation of the outer rotor, wherein the interdental space constituted by the inner rotor and the outer rotor forms an intake stroke in which oil is suctioned through the intake port while the volume thereof is being expanded, an intake end stroke in which oil is suctioned through the intake port while the volume thereof is being expanded, an intake end stroke in which a sealed space is formed subsequent to a shift from the intake port to the partition section, a compression stroke in which, in a state in which a sealed space is formed in the partition section subsequent to an end of the intake stroke, there is no direct opening to the discharge port or the protruding linking groove of the discharge port, and a discharge stroke in which oil is discharged to the discharge port while the volume thereof is being reduced subsequent to a linking thereof with the discharge port or the protruding linking groove of the discharge port, and a linking gap is formed by the recess portion between the interdental space of the compression stroke in the partition section, and a succeeding interdental space in the discharge stroke, wherein the linking gap causes a fluid to flow between the succeeding interdental space and the interdental space of the compression stroke in the partition section, and wherein the linking gap gradually expands accompanying the rotation of the rotor in the compression stroke in the partition section.

18. The trochoid oil pump according to claim 17, wherein a shape of an outer peripheral edge in the contactless region with the tooth profile of the inner rotor formed between the tooth apex portion and the tooth base portion of the tooth profile of the outer rotor is defined by a recess portion with a concavely curved intermediate portion formed inwardly of the tooth profile in a curved shape or a substantially circular arc shape.

19. The trochoid oil pump according to claim 17, wherein the linking gap maintains continuous expansion from a confinement completion state of the interdental space to at least to the compression stroke end state where there is no direct opening in the interdental space of the compression stroke to the discharge port or the protruding linking groove of the discharge port or a state of intersection in the discharge port or the protruding linking groove of the discharge port.

* * * * *